US006394171B1

(12) United States Patent
Robbins, III

(10) Patent No.: US 6,394,171 B1
(45) Date of Patent: May 28, 2002

(54) CLEAR PLASTIC INDUSTRIAL TRAFFIC CURTAIN

(76) Inventor: Edward S. Robbins, III, 128 Hazelwood La., Florence, AL (US) 35630

( * ) Notice: Subject to any disclaimer, the term of this patent is extended or adjusted under 35 U.S.C. 154(b) by 0 days.

(21) Appl. No.: 09/756,343

(22) Filed: Jan. 8, 2001

(51) Int. Cl.[7] ..... E05D 15/00
(52) U.S. Cl. ..... 160/184; 160/332; 428/167
(58) Field of Search ..... 160/330, 332, 160/184; 428/167

(56) References Cited

U.S. PATENT DOCUMENTS

| | | | |
|---|---|---|---|
| 2,122,532 | A | 7/1938 | Mims et al. |
| 4,086,950 | A | 5/1978 | Power |
| 4,095,642 | A | 6/1978 | McKinnon et al. |
| 4,165,778 | A | 8/1979 | Smith |
| 4,232,725 | A | 11/1980 | Gidge |
| 4,289,190 | A | 9/1981 | Catan |
| 4,355,678 | A | 10/1982 | Romano |
| 4,367,781 | A | 1/1983 | Vallieres, Jr. et al. |
| D269,576 | S | 7/1983 | Robbins, Jr. |
| 4,607,678 | A | 8/1986 | Pomaville et al. |

FOREIGN PATENT DOCUMENTS

| | | | |
|---|---|---|---|
| CA | 975286 | * | 12/1975 |
| FR | 1508336 | * | 11/1966 |
| GB | 2237195 | * | 5/1991 |

* cited by examiner

*Primary Examiner*—Blair M. Johnson
(74) *Attorney, Agent, or Firm*—Brinks Hofer Gilson & Lione

(57) ABSTRACT

A material for use in an industrial traffic curtain formed of a flexible transparent material, such as polyvinyl chloride, having a substantially uniform longitudinal cross-section, which can be achieved by way of a conventional extrusion process. The strip of material has a transverse cross-section defined by first and second parallel surfaces, the surfaces having an array of regularly spaced, generally rectangular longitudinal ribs of predetermined height and width. The ribs on the first surface are arranged to be coincident with the ribs on the second surface. Each adjacent pair of ribs on each of the surfaces is interspersed by a linear bead having a height dimension approximating the height dimension of the adjacent pair of ribs. The linear beads have a width dimension less than about 10% of the distance between the adjacent pair of ribs so that the space between each pair of ribs remains substantially transparent and vision through the strip is unimpeded. The overlapping strips are arranged in the curtain so that distal surfaces of the ribs on confronting portions of the overlapping strips are in contact with each other.

20 Claims, 5 Drawing Sheets

CLEAR PLASTIC INDUSTRIAL TRAFFIC CURTAIN

BACKGROUND OF THE INVENTION

The present invention relates generally to industrial curtains used as environmental closures for openings through which traffic can still pass. The curtains generally comprise a plurality of strips suspended contiguously to each other from a hanger fixed adjacent to a top margin of the opening, each strip consisting essentially of a length of flexible material terminating adjacent to a lower margin of the opening. The present invention relates particularly to an improved configuration for the material forming the strips of such industrial curtains so that vision through the curtain is improved.

Goods are often required to be transported from one area of a manufacturing or storage facility to another where one or the other of the areas is heated, air-conditioned or even refrigerated. Sometime other environmental concerns need to be addressed such as dust, fumes, smoke, dirt, or even noise. Where the traffic is only occasional, conventional doors can be employed to close any doorway between the two areas. Where the traffic is considerable, the use of conventional doors gives way to suspended flexible screens or curtains that inhibit the wholesale transfer of heated or cooled air from one area to the other yet still permit goods-transporting vehicles to pass through with little effort. Early screens were sometimes made of rubber as shown, for example, in U.S. Pat. No. 2,122,532. For safety reasons, it is desirable that the curtain be sufficiently transparent that one operating a transporting vehicle be able to see any hazard or obstruction that might exist on an opposite side of a screen before proceeding through. Persons on the opposite side of a screen also desire to be able to see oncoming transport vehicles so appropriate evasive action can be taken. Thus, plastic materials, which were more or less transparent, such as polyvinyl chloride and polyethylene, were adopted as the preferred materials for forming such screens as shown, for example, in U.S. Pat. Nos. 4,095,642, 4,165,778, 4,232,725, 4,367,781, and 4,607,678.

Plastics such as polyethylene and polyvinyl chloride have two characteristics that have been recognized as detrimental to completely satisfactory performance in industrial doorway curtains. First, the plastic strips are often electrostatically attracted to each other so that they resist separation from each other as the goods and transporting vehicles attempt to pass through the curtain. This problem is particularly evident with the curtain is initially installed. Second, the plastics are generally much softer than the edges and corners of the transporting vehicles and goods packages that pass through the curtains. Thus, the curtain strips quickly become scuffed and scratched by the passing traffic to the point that the originally transparent strips become effectively opaque. In attempting to solve both of these and other related problems special overlapping attachments have been added to the strips, the edges of the strips have included bulbous enlargements, and ridges have been added to the body of the strips as shown, for example, in U.S. Pat. Nos. 4,086,950 and 4,289,190. Despite these attempts to solve the problems of electrostatic attraction and visibility, the problems remain.

The present invention attempts to directly address the problem of preventing scuffing and scratching of the strips of plastic forming the curtain thus ensuring substantially transparency of the strips and ensuring that vision through the strip is unimpeded while at the same time forming a curtain of minimal cost.

SUMMARY OF THE INVENTION

A material for use in an industrial traffic curtain in accordance with the present invention consists essentially of a length, as needed, of a flexible transparent material, such as polyvinyl chloride, having a substantially uniform longitudinal cross-section, which can be achieved by way of a conventional extrusion process. The strip of material has a transverse cross-section defined by first and second parallel surfaces defining a web of the curtain, the surfaces having an array of regularly spaced, generally rectangular longitudinal ribs of predetermined height and width. The ribs on the first surface are arranged to be coincident with the ribs on the second surface. In one embodiment, each adjacent pair of ribs on each of the surfaces is interspersed by a linear bead having a height dimension approximating the height dimension of the adjacent pair of ribs. The linear beads have a width dimension less than about 10% of the distance between the adjacent pair of ribs so that the space between each pair of ribs remains substantially transparent and vision through the strip is unimpeded. In another embodiment the intermediate linear beads are formed to have substantially the same shape and dimension as the ribs, so that a greater portion of the mass of the curtain is provided in the ribs than in the web forming the essentially transparent portion of the curtain material.

Generally, the thickness of the plastic forming the web of the curtain, measured between the first and second surfaces, is between about 0.020 in. and 0.080 in. This web thickness is generally thinner than most conventional industrial traffic curtain materials, which contributes to a lower cost for the present product. There is a practical lower limit on the thickness of such curtain materials, as a material that is too thin will be easily disturbed by air currents, which is inconsistent with the purpose of such curtain materials to constitute environmental barriers. The height of the ribs, on the other hand, is generally proportionately greater than conventional industrial traffic curtain materials, which provides the necessary resistance to air currents, thus allowing the thinning of the web portion which again contributes to a lower cost for the present product.

The ribs are also spaced apart by a distance that is only about ¼ to ½ the usual spacing. This narrower rib spacing has the tendency to protect the intervening surfaces of the curtain from abrasion far better than conventional industrial curtain materials. The closer spacing has the added advantage of causing less cuts and other injuries to persons passing thorough the curtain. The narrower spacing coupled with the opposed positioning of the ribs provides advantages both in the manufacturing process and in use. In the manufacturing process, the opposed positioning of the ribs provides a better coiling surface for better handling of the curtain material. The opposed positioning and narrow spacing improves the thermal insulating function of the curtain by trapping more air in the pockets created between the ribs.

In one embodiment, linear beads are positioned about midway between the more narrowly spaced ribs. The height of the outermost surface of the linear beads above the supporting surface is generally between about 60% and 80% of the height of the rectangular ribs. The linear beads aid in preventing abrasion of the surface of the web material by passing machinery in a manner similar to the ribs. The width of the linear beads is generally between only about 5% and 15% of the distance between adjacent ribs. This width for the intervening beads is much smaller than any ribs previously employed, which has the advantage of presenting such a small line disturbance on the web surface that the presence of the linear bead does not significantly detract from the visibility through the web during use. The cross-sectional shape of the linear bead can be essentially semicircular or triangular to best protect the screen surface from abrasion.

Unlike prior plastic strip doors, such as are shown in U.S. Pat. Nos. 4,086,950 and 4,289,190, each strip is provided with a regularly spaced coincident series of ribs on both sides of each strip, the ribs having sufficient width to allow the overlapping strips forming the curtain to be positioned so that the outer surfaces of the ribs are confronting and contacting each other when the curtain is undisturbed. The spaces defined between the ribs form insulating pockets that improve the environmental barrier performance of the curtain, without reducing visibility through curtain. The closely spaced ribs act to protect the web surfaces between the ribs, while the narrow contact area of the confronting rib surfaces diminishes any electrostatic attraction between the curtain strips.

Other features and advantages of the present invention will become apparent to those skilled in the art upon considering the following description of the preferred embodiments of the present invention, which makes reference to the accompanying drawings.

DESCRIPTION OF THE PREFERRED EMBODIMENTS

Figure 1:
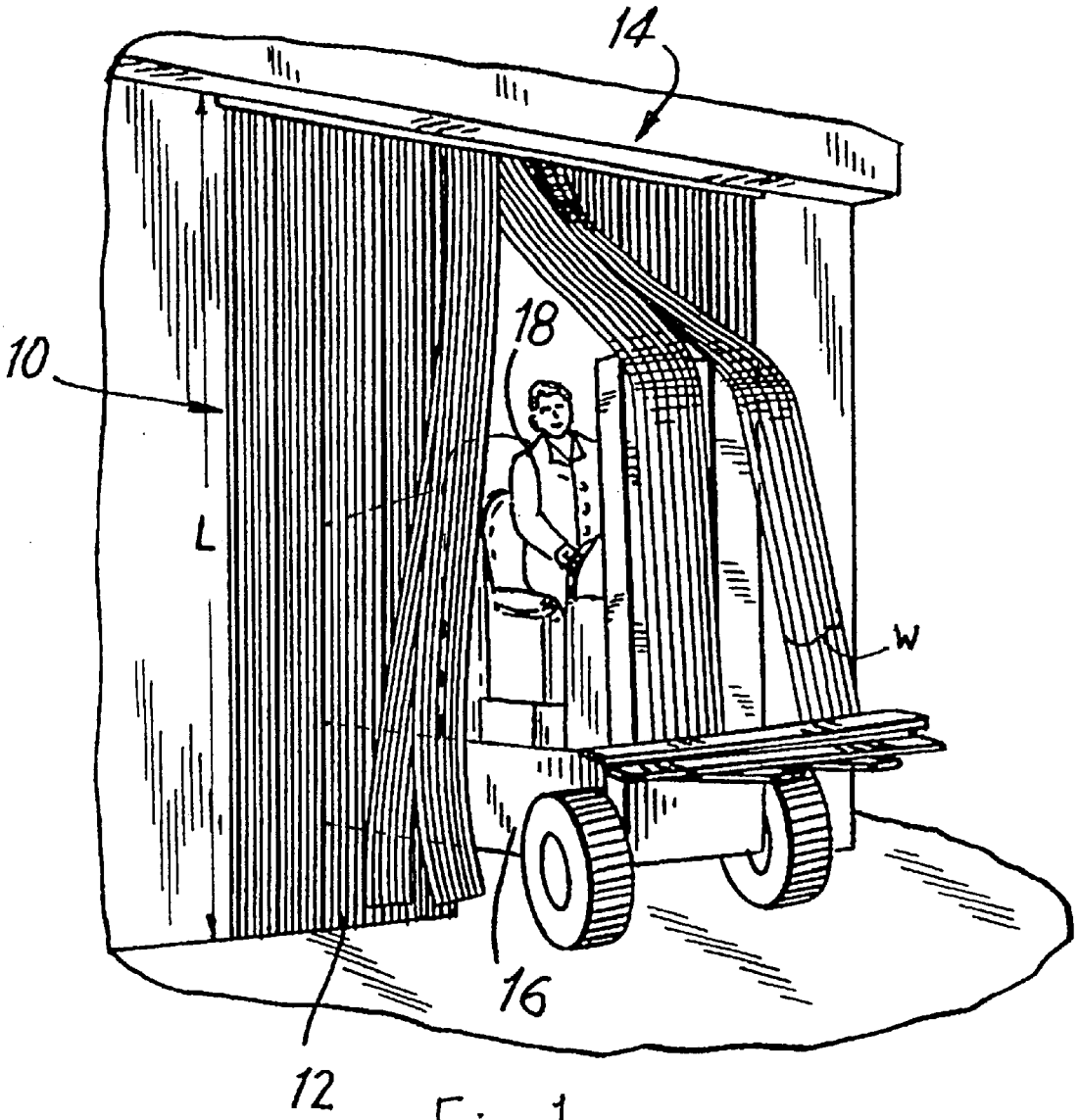
FIG. 1 is a perspective view of an industrial curtain installation in which the present invention can be employed.

An industrial traffic curtain 10 comprising a plurality of individually suspended strips 12 in accordance with the present invention is shown installed in a doorway 14 in FIG. 1. The individual strips 12 consist essentially of a length L, as needed, of a flexible transparent plastic material, such as polyvinyl chloride, having a substantially uniform width W and a uniform longitudinal cross-section as shown and described in connection with FIGS. 2–4. The width W of the strips 12 can be any dimension, but are typically fixed at two inch increments between about 6 and 16 inches. The strips 12 of plastic material can be formed by a conventional extrusion process. The strips 12 are intended to be sufficiently transparent that an on-coming goods transporting vehicle 16 would be generally visible through the curtain 10. The strips 12 are also intended to be sufficiently transparent that an operator 18 of such a goods transporting vehicle 16 would be able to survey the area on a far side of the curtain 10 before proceeding through the doorway 14. The substantially transparent character of the curtain 10 is only slightly reduced by the presence of more than one layer of strips 12.

Figure 3:
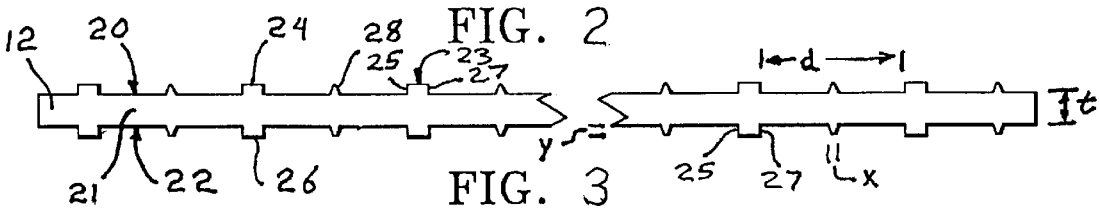
FIG. 3. is an end sectional view of the material shown in FIG. 2 showing a lateral cross-sectional view of the material forming the strip in accordance with the present invention.
Figure 5:
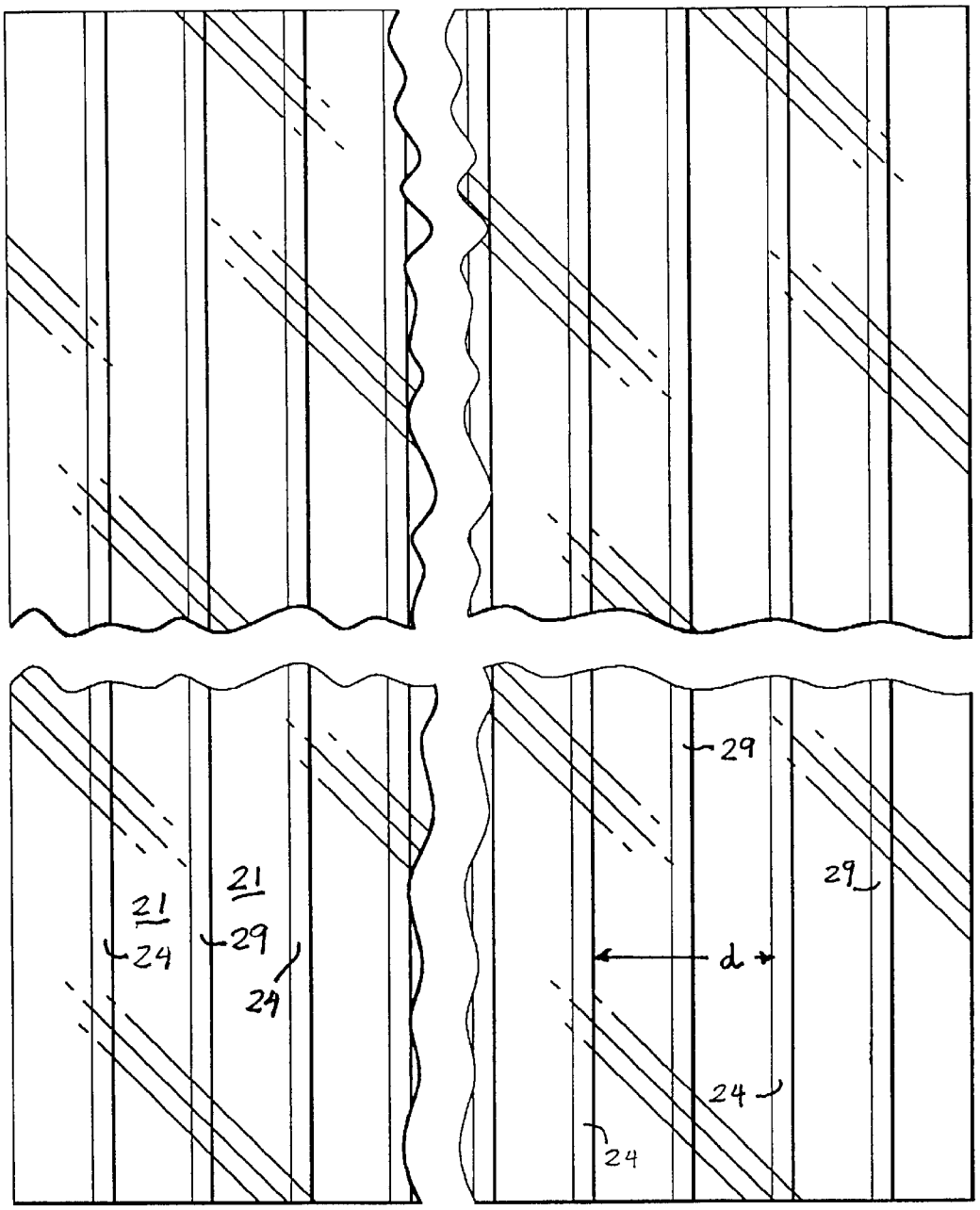
FIG. 5 is a front elevation view of another strip of material for forming a curtain in accordance with the present invention.

In the two illustrated embodiments of the present invention, each strip 12 of material has a transverse cross-section, shown in FIGS. 3 and 5, and defined by first and second parallel surfaces 20 and 22, respectively, that together define the web portion 21 of the strip 12. Generally, the thickness t of the web material measured between the first and second surfaces 20 and 22 is generally between about 0.020 inches and 0.080 inches. This web thickness is considerably thinner than most conventional industrial traffic curtain materials, which contributes to a lower cost for the present product. This thin web structure can be achieved by providing ribs 24 and 26 at much closer spacing than normal, which prevent any significant disturbance of the curtain 10 by air currents.

The surfaces 20 and 22 have an array of regularly spaced, generally rectangular longitudinal ribs 24 and 26 of predetermined height h defined by the distance between the supporting surface 20 or 22 of web 21 and a distal surface 23 of the rib. Each of the longitudinal ribs 24 and 26 also is defined by lateral surfaces 25 and 27 that are separated from each other by width w. The height h of the ribs 24 and 26 is generally identical, and is typically between about 0.060 inches and 0.100 inches. The height of the ribs is generally greater that conventional industrial traffic curtain materials, particularly when considered in relation to the thinness of the web. The width w of the ribs 24 and 26 is generally also identical, and is typically between about 0.120 inches and 0.200 inches. The ribs 24 on the first surface 20 are arranged to be coincident with the ribs 26 on the second surface 22. Each of ribs 24 or 26 on each of the surfaces 20 or 22 is separated from adjacent ribs 24 or 26 on the same surface by a separation distance d that is typically between about one-half and one inch, which is only about ¼ to ½ the spacing of conventional ribs on industrial curtains of this general type. This narrower rib spacing d has the tendency to protect the intervening surfaces 20 and 22 of the web 21 of the curtain 10 from abrasion better than conventional industrial curtain materials. The spacing coupled with the height has the added advantage of causing less cuts and other injuries to persons passing thorough the curtain.

Figure 2:
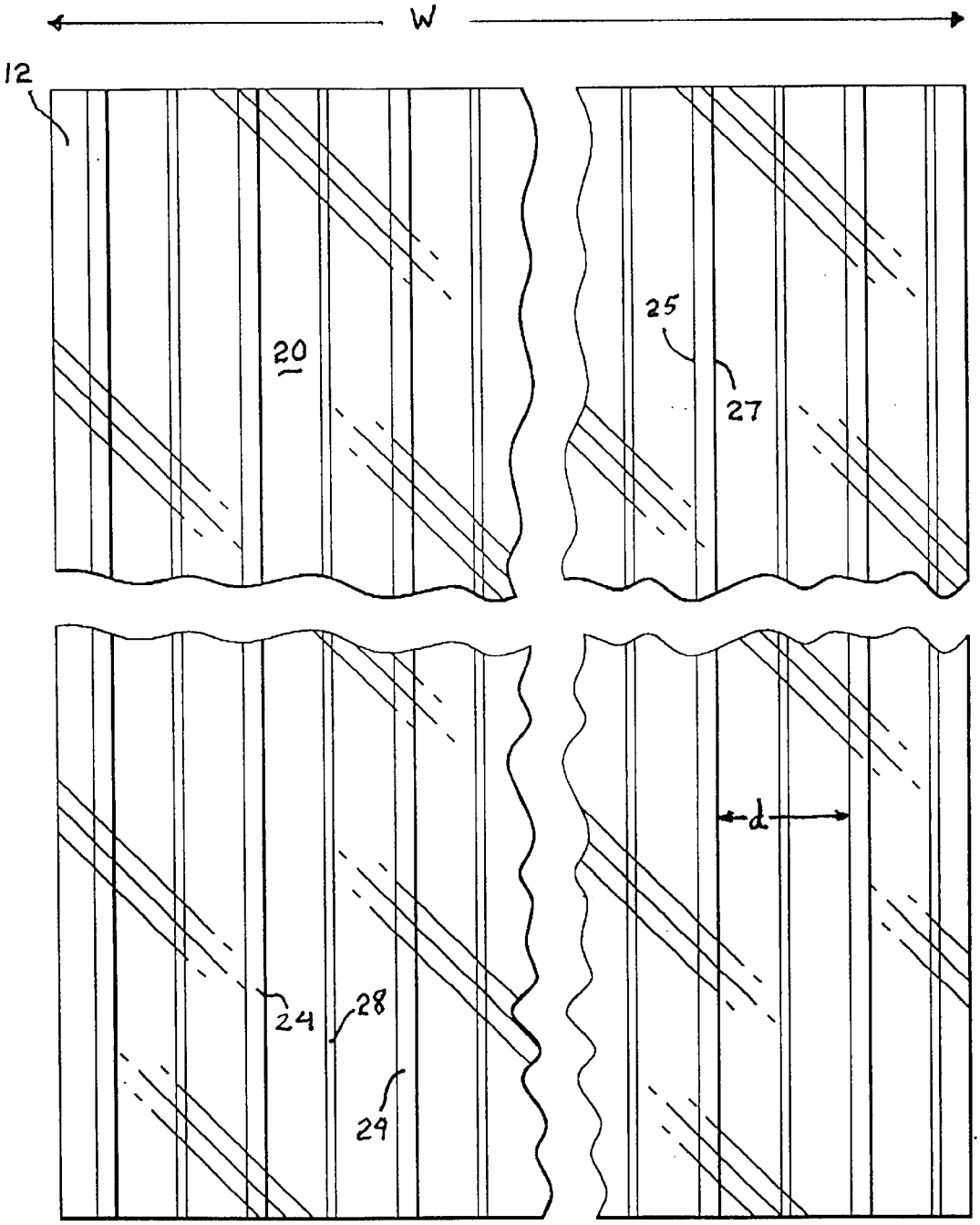
FIG. 2 is a front elevation view of a strip of material for forming a curtain in accordance with the present invention.

In the embodiment shown in FIGS. 2 and 3, each adjacent pair of ribs 24 or 26 on each of the surfaces 20 or 22 is interspersed by a linear bead 28 positioned approximately midway between each adjacent pair of ribs. Each linear bead 28 has cross-sectional shape that is essentially triangular or semicircular, with the width x of the base 30 of each linear bead 28 being generally greater than the height y. The height y of the linear bead 28 is generally about the same or somewhat less than the height dimension h of the adjacent pair of ribs. The width x of the linear beads 28 is less than about 10% of the distance d between the adjacent pair of ribs so that the space between each pair of ribs remains substantially transparent, and vision through the strip is unimpeded by the presence of the bead itself. The linear beads 28 aid in preventing abrasion of the surfaces 20 and 22 of the strip material 12 by passing machinery similar to the ribs 24 and 26, but with less distortion of the light passing through the curtain 10. The width x of the beads 28 is much smaller than any ribs previously employed on industrial curtains, which has the advantage of presenting such a small line disturbance that the presence of the linear bead does not significantly detract from the visibility through the screen during use.

Figure 4:
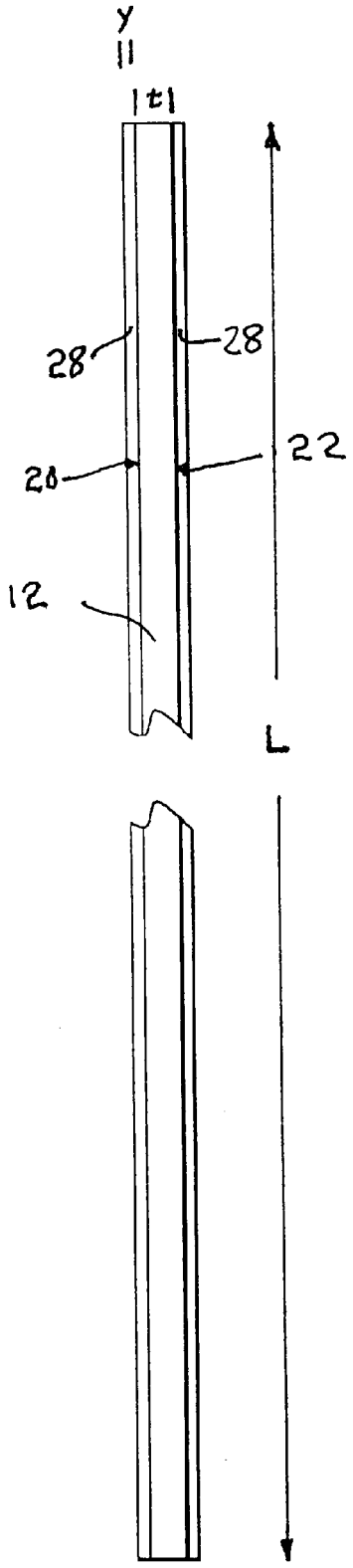
FIG. 4 is a side elevation of the material shown in FIG. 3.
Figure 6:
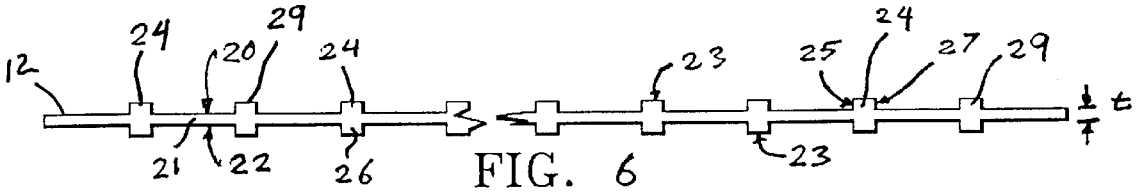
FIG. 6. is an end sectional view of the material shown in FIG. 5 showing a lateral cross-sectional view of the material.
Figure 7:
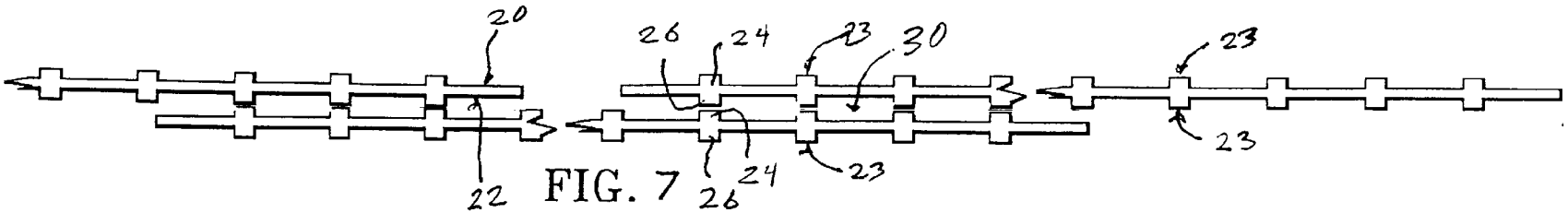
FIG. 7 is a sectional view of a curtain formed of the material shown in FIGS. 5 and 6 showing the preferred relative arrangement of the strips in accordance with the present invention.

The embodiment illustrated in FIGS. 5 through 7 can be considered as merely a variation of the first embodiment shown in FIGS. 2 through 4 wherein the width x and height y of the beads 29 is enlarged, and the shape is made to be identical with the ribs 24 and 26, while the distance between the ribs is maintained the same as in the first embodiment. While this embodiment may employ slightly more plastic resin than the first embodiment at the same web thickness, the added weight to the beads 29 may permit the web 21 of the curtain strip 12 to be made even thinner. The wider bead 29 adds support for any rolling of the strip 10 during manufacture. The wider bead 29 also increases the area of contact for the most desirable configuration a curtain 10 of the present invention, as shown in FIG. 7. In the preferred arrangement of curtain 10, at least two layers of strips 12 are employed in an overlapping relationship, and the distal surfaces 23 of the ribs 24 and 26 on adjacent strips 12 are in abutting relation so that the area of the contacting surface is minimized thereby reducing the electrostatic attraction between the strips and facilitating the passage of goods and transporting vehicles the curtain. When the curtain 10 is simply hanging as shown in FIG. 7, the spaces between the ribs 24 and 26 capture many isolated, small columns of air 30 which enhance the environmental isolation between the two sides of the curtain 10. The narrow spacing of the ribs 24 and 26 also ensures enhanced protection for the web surfaces 20 and 22 between the ribs thereby reducing surface abrasion. In this second embodiment, the thickness of the web 21 is preferably between about 0.020 and 0.080 inches, the height of the distal surface 23 of the ribs 24 and 26 above the respective supporting surfaces 20 and 22 is between about 0.060 and 0.100 inches, while the width of the ribs 24 and 26 is between about 0.120 and 0.200 inches, and the ribs are separated from each other by a separation distance d that is between about one-half and one inch.

While the present invention has been described in connection with the illustrated preferred embodiments, other embodiments of the present invention will be apparent to those skilled in the art from the forgoing summary of the invention as well as from the following claims.

What is claimed is:

1. An industrial traffic curtain for use as a closure for an opening, the curtain comprising a plurality of overlapping strips suspended contiguously to each other from a hanger fixed adjacent to a top margin of the opening, each strip consisting essentially of a length of flexible transparent material terminating adjacent to a lower margin of the opening, each strip having first and second parallel surfaces, the surfaces having an array of regularly spaced, generally rectangular longitudinal ribs of predetermined height and width, the ribs on the first surface being arranged to be coincident with the ribs on the second surface, the overlapping strips being situated so that distal surfaces of the ribs on confronting portions of the overlapping strips are in contact with each other.

2. The industrial traffic curtain of claim 1 wherein each adjacent pair of ribs on each of the surfaces is interspersed by a linear bead having a height dimension approximating the height dimension of the adjacent pair of ribs and a width dimension less than about 10% of the distance between each adjacent pair of ribs so that the space between each pair of ribs remains substantially transparent and vision through the overlapping strips is unimpeded.

3. The industrial traffic curtain of either of claim 1 or 2 wherein the thickness of the material measured between the first and second surfaces is between about 0.020 inches and 0.080 inches.

4. The industrial traffic curtain of claim 3 wherein the height of the outermost surface of the ribs above the supporting surface is between about 0.060 inches and 0.100 inches.

5. The industrial traffic curtain of claim 3 wherein the width of the ribs is between about 0.120 inches and 0.200 inches.

6. The industrial traffic curtain of claim 2 wherein the cross-sectional shape of the linear bead is essentially semicircular.

7. The industrial traffic curtain of claim 2 wherein the cross-sectional shape of the linear bead is essentially triangular.

8. A material for use in an industrial traffic curtain closure for an opening, the curtain generally formed from a plurality of strips suspended contiguously to each other from a hanger fixed adjacent to a top margin of the opening, each strip consisting essentially of a length of the material terminating adjacent to a lower margin of the opening, the material being flexible and transparent and having first and second parallel surfaces defining a web, each of the surfaces supporting an array of regularly spaced, generally rectangular longitudinal ribs, each rib having a distal face spaced from the rib-supporting surface by a distance of less than about 40% of the distance between the first and second parallel surfaces, each rib having a width of more than 60% of the distance between the first and second parallel surfaces, the ribs on the first surface being arranged to be coincident with the ribs on the second surface, and a linear bead situated between each adjacent pair of ribs on each of the surfaces, each linear bead having a height dimension approximating the height dimension of the adjacent pair of ribs and a width dimension less than about 10% of the distance between the adjacent pair of ribs so that the space between each pair of ribs remains substantially transparent and vision through the strip is unimpeded.

9. The improved material of claim 8 wherein the thickness of the web is between about 0.020 inches and 0.080 inches.

10. The improved material of claim 9 wherein the height of the outermost surface of the linear beads above the supporting surface is between about 50% and 200% of the thickness of the web.

11. The improved material of claim 9 wherein the width of the linear beads is between about 5% and 15% of the distance between adjacent ribs.

12. The improved material of claim 9 wherein the total width of the material is between about 6 inches and 16 inches.

13. The improved material of any of claim 8 through 12 wherein the cross-sectional shape of the linear bead is essentially semicircular.

14. The improved material of any of claim 8 through 12 wherein the cross-sectional shape of the linear bead is essentially triangular.

15. A material for use in an industrial traffic curtain closure for an opening, the curtain generally formed from a plurality of strips suspended contiguously to each other from a hanger fixed adjacent to a top margin of the opening, each strip consisting essentially of a length of the material terminating adjacent to a lower margin of the opening, the material being flexible and transparent and having first and second parallel surfaces, each of the surfaces supporting an array of regularly spaced, generally rectangular longitudinal ribs, each rib having a distal face spaced from the rib-supporting surface by a distance of less than about 40% of the distance between the first and second parallel surfaces, each rib having a pair of lateral faces spaced from each other to define a rib width of more than 60% of the distance between the first and second parallel surfaces, the ribs on the first surface being arranged to be coincident with the ribs on the second surface, and a linear bead situated between each adjacent pair of ribs on each of the surfaces, the linear bead by having a height dimension approximating the height dimension of the adjacent pair of ribs and having a width dimension less than about 10% of the space between each adjacent pair of ribs so that the space between each pair of ribs remains substantially transparent and vision through the strip is unimpeded.

16. The improved material of claim 15 wherein the height of the outermost surface of the linear beads above the supporting surface is between about 50% and 200% of the thickness of the material and the width of the linear beads is between about 100% and 400% of the thickness of the material.

17. The improved material of either of claim 15 or 16 wherein the cross-sectional shape of the linear beads is essentially semicircular.

18. The improved material of either of claim 15 or 16 wherein the cross-sectional shape of the linear beads is essentially triangular.

19. The improved material of either of claim 15 or 16 wherein the height of the outermost surface of the ribs above the supporting surface is between about 0.060 inches and 0.100 inches.

20. The improved material of either of claim 15 or 16 wherein the width of the ribs is between about 0.120 inches and 0.200 inches.

* * * * *